US009260889B2

(12) United States Patent
Stijns et al.

(10) Patent No.: US 9,260,889 B2
(45) Date of Patent: Feb. 16, 2016

(54) TILT PREVENTION ASSEMBLY FOR A SERIES OF DRAWERS IN A TOOL CABINET

(71) Applicant: Thomas Regout International B.V., Maastricht (NL)

(72) Inventors: Andreas Petronella Maria Stijns, Bunde (NL); Ronald Alexander Cornelissen, Stein (NL)

(73) Assignee: Thomas Regout International B.V., Maastricht (NL)

( * ) Notice: Subject to any disclaimer, the term of this patent is extended or adjusted under 35 U.S.C. 154(b) by 0 days.

(21) Appl. No.: 14/245,497

(22) Filed: Apr. 4, 2014

(65) Prior Publication Data

US 2014/0300257 A1 Oct. 9, 2014

(30) Foreign Application Priority Data

Apr. 5, 2013 (NL) ..... 2010579

(51) Int. Cl.
*E05B 65/46* (2006.01)
*E05B 15/00* (2006.01)
*B25H 3/02* (2006.01)

(52) U.S. Cl.
CPC ..... *E05B 65/465* (2013.01); *B25H 3/028* (2013.01); *E05B 15/0053* (2013.01)

(58) Field of Classification Search
CPC ..... E05B 65/468; E05B 65/44; E05B 65/46; E05B 65/462; E05B 65/463; E05B 65/464; E05B 65/465; E05B 15/0053; B25H 3/028
USPC ..... 312/107.5, 215, 216, 217, 220, 221
See application file for complete search history.

(56) References Cited

U.S. PATENT DOCUMENTS

| | | | | | |
|---|---|---|---|---|---|
| 3,560,068 | A | * | 2/1971 | Ostrom | 312/217 |
| 3,881,793 | A | | 5/1975 | Anderson | |
| 4,352,529 | A | * | 10/1982 | Steinke | 312/222 |
| 4,452,498 | A | * | 6/1984 | Wood et al. | 312/216 |
| 4,711,505 | A | * | 12/1987 | Lakso | 312/220 |
| 4,804,876 | A | * | 2/1989 | Lannert et al. | 312/221 |
| 4,993,784 | A | * | 2/1991 | Dana et al. | 312/221 |
| 5,862,689 | A | * | 1/1999 | Wen | 70/85 |

(Continued)

FOREIGN PATENT DOCUMENTS

| | | |
|---|---|---|
| DE | 2553424 | 6/1977 |
| DE | 2932519 | 2/1981 |
| DE | 3732737 | 12/1988 |

OTHER PUBLICATIONS

International Search Report and Written Opinion of NL 2010579 dated Jan. 23, 2014.

*Primary Examiner* — James O Hansen
(74) *Attorney, Agent, or Firm* — Elizabeth A. Peters; Barnes & Thornburg LLP

(57) ABSTRACT

The invention relates to a tilt prevention assembly for a series of drawers in a tool cabinet, comprising a frame which, when in use, is connected to the tool cabinet, as well as a securing member pivotably mounted to the frame, which securing member is pivotable between a securing position in which the securing member forms an obstruction for the movement of the closed drawers, and between a releasing position in which a drawer is moveable at least to an extended position. The tilt prevention assembly also comprises an actuator member that is arranged for pivoting the securing member under the influence of the movement of the drawers to the securing position or the releasing position.

3 Claims, 11 Drawing Sheets

(56) References Cited

U.S. PATENT DOCUMENTS 7,144,092 B1 * 12/2006 Chang ..... 312/217
7,524,003 B2 * 4/2009 Liu ..... 312/221
2008/0074017 A1 * 3/2008 Ruan et al. ..... 312/221
2008/0157642 A1 7/2008 Liu

* cited by examiner

TILT PREVENTION ASSEMBLY FOR A SERIES OF DRAWERS IN A TOOL CABINET

FIELD OF INVENTION

The invention relates to a tilt prevention assembly for a series of drawers in a tool cabinet, comprising a frame which, when in use, is connected to the tool cabinet, as well as a securing member pivotably mounted to the frame, which securing member is pivotable between a securing position in which the securing member forms an obstruction for the movement of the closed drawers, and between a releasing position in which a drawer is moveable at least to an extended position, as well as comprising an actuator member that is arranged for pivoting the securing member under the influence of the movement of the drawers to the securing position or the releasing position.

BACKGROUND OF INVENTION

A tilt prevention assembly is known from WO962557, and is used to prevent two drawers of a tool cabinet to be in the open position at the same time, thereby reducing the chance of tilting the tool cabinet. In the known tilt prevention mechanism two plate shaped members are provided, which are connected to one another via a pivotable mechanism. The plate shaped members collaborate with a cam provided on each of the drawers. Therein one of the plate shaped members is implemented such that it can be brought to a securing position, in which securing position the plate shaped member abuts the cam, such that the drawer is unable to move outwards. The other plate shaped member is implemented such that it, under the influence of the cam on the drawer, brings the first plate shaped member to the releasing position, when pushing the extended drawer back.

A drawback of the known tilt prevention assembly is, that it is relatively complex, with relatively a lot of components, thereby making the assembly relatively difficult and costly to produce. The plate shaped members are unstable, as a consequence of which a blow to the tool cabinet, as in the case of riding over a cable with a moveable tool cabinet, can cause the plate shaped members to pivot to the securing position. Then, it is no longer possible to open a drawer. Due to the relative complexity of the assembly, the reliability of the known assembly is less than to be desired.

SUMMARY OF INVENTION

It is thus an aim of the present invention to provide an improved tilt prevention assembly, which is relatively simple, and which is preferably cheap to produce, and which has an increased reliability.

This aim is achieved with the tilt prevention assembly as described in the present disclosure. The tilt prevention assembly according to the present invention comprises a frame, which, when in use, is connected to the tool cabinet, as well as a securing profile pivotably mounted to the frame with a first profile part and a second profile part which extends from the first profile part at an angle. The securing profile is pivotable between a securing position in which the securing profile forms an obstruction for the movement of the series of closed drawers, and between a releasing position in which one of the series of drawers is moveable to at least an extended position. The securing profile comprises a securing surface which in the securing position forms an obstruction for the movement of the closed drawers of the series of drawers. The sides of the first profile part and the second profile part, which sides are facing each other, define at least two actuator surfaces arranged to collaborate with the series of drawers, for example with an actuator cam on one of the series of drawers, for pivoting the securing profile, under the influence of the movement of one of the series of drawers, into the securing position or the releasing position. By application of the securing profile with the first profile part and the second profile part, which also comprises the actuator surface, the function of the actuator member and the function of the securing member, as these are known from the prior art, are combined into a single profile. According to the present invention, the securing surface and the actuator surfaces are merged into a single securing profile. Thus, the complicated transmission between an actuator member and a securing member, as is customary in the prior art, is no longer required, as a consequence of which the tilt prevention assembly according to the present invention can be implemented simpler and cheaper. Since there are fewer moving parts, the workings of the tilt prevention assembly according to the present is also more reliable.

According to the present invention the tilt prevention assembly further comprises slide prevention means connected to the frame. These slide prevention means comprise a plurality of blocking elements arranged in a row, which blocking elements, when in use, are moveable perpendicularly to the sliding direction of the drawers. The blocking elements however have limited room to move, and in such a way that there is a predetermined maximum interspace through which a part of the drawer, such as for example a cam element on said drawer, can move. By selecting the interspace to be limited such that only one cam element at a time is able to be moved, the simultaneous opening of two drawers is prevented.

Thus, according to the present invention, a reliable tilt prevention assembly is provided, which prevents two drawers from being open at the same time. Additionally the tilt prevention according to the present invention assembly prevents the simultaneous opening of two drawers. Thereby the tilt prevention assembly according to the present invention becomes reliable. Additionally the tilt prevention assembly according to the present invention is implemented in a simplified manner, and it is relatively cheap to produce. Thereby the aim of the present invention has been achieved.

Further advantageous embodiments will be discussed hereafter.

In an embodiment, the securing surface is formed by a side of the second profile part which is facing away from the first profile part.

In an embodiment, the securing profile is implemented in the form of a securing bar. The application of the securing bar allows the tilt prevention assembly to, when in use, extend in the height direction of the tool cabinet, such that all drawers provided therein can be brought into decent contact with the securing bar, regardless of the height position of the drawers. In this way it is not required anymore to have a securing mechanisms for each drawer, which needs to be provided at the appropriate height, but only a single securing bar suffices for the series of drawers.

The tilt prevention assembly can be formed in a simple manner, when the side of the first profile part, which side is facing the second profile part, comprises a first actuator surface arranged to collaborate with a drawer for pivoting the securing profile to the securing position, and wherein the side of the second profile part which side is facing the first profile part comprises a second actuator surface arranged to collaborate with a drawer for pivoting the securing profile to the releasing position.

A compact embodiment is possible when the first profile part and the second profile part enclose an angle α which is between 60 degrees and 100 degrees. Preferably the angle α is about 80 degrees.

In an embodiment, the tilt prevention assembly comprises urging means for urging the securing profile to the securing position and/or to the releasing position. The urging means preferably comprise a spring located between the frame and the securing profile, such as a leaf spring. In one embodiment the urging means are formed by a first urging part pivotably connected to the frame at a first end. At a further end of the first urging part the second urging part is located which can move in a limited manner in the longitudinal direction of the first urging part, as a consequence of which the urging parts can slide in and out of one another. The second urging part is pivotably connected to the securing profile. A spring between both driving parts urges the securing profile into the securing position or the releasing position.

A decent activation, or pivoting between the securing position and the releasing position, is possible when the first profile part is substantially rigidly connected to the second profile part. However, it is particularly preferred that the securing profile is integrally formed. It has been shown that the securing profile according to the present invention can be produced in a particularly simple manner by means of for example extrusion. In this manner an extruded securing profile, in the form of a securing bar, can be produced.

A compact construction becomes possible when the securing profile is pivotable about a pivoting axis, which is located substantially between the first profile part and the second profile part. Thereby the pivoting axis and the ends of the first and second profile parts can form a triangle, wherein the distance between the ends of the first and second profile parts defines the longest side of the triangle.

The securing profile can be provided with axis mounting means, such as for example a recess formed in the securing profile, with which mounting means the securing profile is mountable to a pivoting axis connected to the frame. In an embodiment, the securing profile has, at the location of the circular recess, the shape of a half-moon, with two axis mounting arms facing towards each other, and defining a partial circumference of the circular recess. In this manner a simple and solid pivoting connection can be established.

It is preferred that the sides of the first profile part and the second profile part, which sides are facing each other, are connected to one another in a continuing proceeding manner, for forming a substantially smooth profile surface. The profile surface is then curved. The actuator surfaces on the first and the second profile part then proceed continuously, and smoothly into one another, such that a actuator of the drawer, for example a cam on that drawer, can move smoothly along the curved profile surface.

The pivoting of the securing profile is preferably limited to a pivoting between the securing position and the releasing position. To this end the securing profile is preferably provided with at least one stop arranged to collaborate with a stop surface on the frame for preventing a pivoting of the securing profile beyond the securing position and/or the releasing position.

As mentioned above, the assembly can be provided with blocking elements. In an embodiment two, adjacent blocking elements define tapered guiding surfaces.

In an embodiment the blocking elements are shaped as substantially polygonal, preferably square or octagonal. The corners can be rounded for a gradual movement of the blocking elements.

The tilt prevention assembly further comprises in an embodiment a number of actuator members which, when in use, are each connected to one of the drawers, wherein the actuator members each comprise a cam part arranged to collaborate with the actuator surfaces of the securing profile. The cam parts of the actuator members are thus arranged to bring the securing profile alternatingly to the securing position en the releasing position.

The cam part in is an embodiment substantially L-shaped, wherein the base of the L is arranged to collaborate with the actuator surfaces of the securing profile.

For smooth guidance, the base of the L comprises a first cam surface which, when in use, is facing the drawer, as well as a second cam surface which, when in use, is facing away from the drawer, wherein the first cam surface is arranged to collaborate with the first actuator surface, and wherein the second cam surface is arranged to collaborate with the second actuator surface. The first and second cam surface extend preferably at an angle with respect to one another.

The tilt prevention assembly comprises in an embodiment a lock fixing the securing profile in the securing position by means of an actuator. The pivoting of a key organ at the front side of the tool cabinet is transferred by means of a bar, which moves a lock on the frame. The bar engages on a recess in the lock. A locking member moves, by means of contact with the securing profile, the securing profile in the securing position: the closed drawers are blocked. Thereby it is not possible to move a closed drawer to an extended position. Now, to allow an opened drawer in such a condition of the securing profile to be closed anyway, the drawer, preferably the actuator member on that drawer, is arranged in an embodiment to be able to pass the securing profile in the securing position when closing said drawer. This can be achieved by implementing the actuator member as partially flexible. In an embodiment the actuator member passes the securing profile by the bending of a cam part when the first cam surface contacts the first actuator surface. This prevents a user from unnecessarily having to unlock the tool cabinet.

Unlocking proceeds by a opposite pivoting movement of the key organ wherein by means of the bar the lock is moved such that an unlocking member on the lock brings the securing profile back to the releasing position.

As mentioned above, the tilt prevention assembly can be provided with slide prevention means. In that case the actuator member can be provided with a slide prevention member arranged for, when in use, during sliding out of a drawer, moving the blocking elements of the slide prevention means.

This slide prevention member extends in a direction transverse to the drawer sliding-out direction. The slide prevention member can comprise a block shaped thickening arranged to drive the blocking elements away and to pass the blocking elements only when a single drawer is extended. When two drawers are extended, the available space between the blocking elements is too small, such that the blocking elements can not be moved any further, as a consequence of which at least one of the two drawers will block.

It is thereby noted that the above described embodiment with the slide prevention means is also separately applicable combined with a securing member and an actuator member. According to an aspect, the present invention thus provides a tilt prevention assembly for a series of drawers in a tool cabinet, comprising a frame, which, when in use, is connected to the tool cabinet, as well as a securing profile pivotably mounted to the frame which is pivotable between a securing position in which the securing profile forms an obstruction for the movement of closed drawers, and between a releasing position in which a drawer is moveable to at least an extended position, as well as an actuator member which is arranged under the influence of the movement of the drawers to pivot the securing profile to the securing profile or the releasing position, as well as slide prevention means mounted to the frame. The invention describes a tilt prevention assembly which prevents the simultaneous opening of multiple drawers, by means of which the stability of the tool cabinet is at all times sufficient to prevent tilting of the tool cabinet: the tool cabinet is safe for users. The described tilt prevention assembly is also stable and prevents unwanted obstruction of the drawers.

According to an aspect, the present invention provides a tool cabinet, comprising a number of drawers mounted in guides, wherein said tool cabinet is characterized in that it comprises a tilt prevention assembly according to the present invention. The advantages thereof have been discussed above.

BRIEF DESCRIPTION OF THE DRAWINGS

The present invention will now be explained in more detail by a description of a preferred embodiment of a tilt prevention assembly according to the present invention, with reference to the enclosed schematic figures, in which.

DETAILED DESCRIPTION

Figure 1:
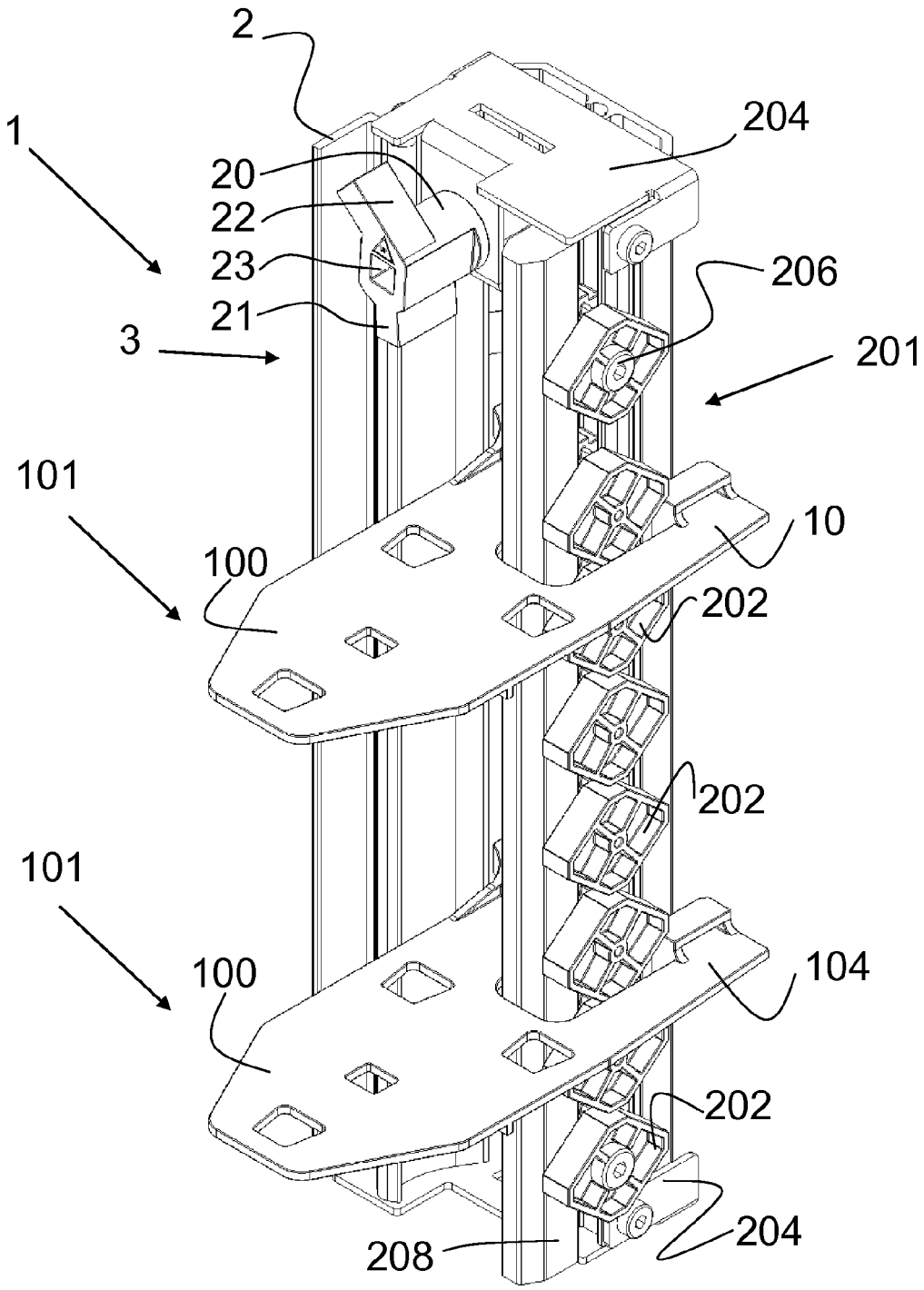
FIG. 1 shows a perspective view of the tilt prevention assembly according to the present invention, comprising two actuator members that are mountable on drawers of a tool cabinet.

FIG. 1 shows a perspective view of the tilt prevention assembly 1 according to an embodiment of the present invention. The tilt prevention assembly 1 comprises a frame 2, which is substantially formed from a profile, and which is mountable to a tool cabinet (not shown) in which drawers (not shown) are slideably connected. The frame 2 is preferable connected near a rear side of the tool cabinet, such that the frame 2 is placed between a rear wall of the tool cabinet and rear sides of the drawers placed in the tool cabinet.

The frame 2 comprises a substantially U-shaped formed profile, whereby a first leg of the U (left side in FIG. 1) is provided with securing means 3, which are arranged for, in the presence of a least one extended drawer, preventing movement of closed drawers, or at least preventing opening of closed drawers. A second leg of the U (right side in FIG. 1) is provided with slide prevention means 201, which are suitable to prevent simultaneous opening of two or more drawers.

Figure 2:
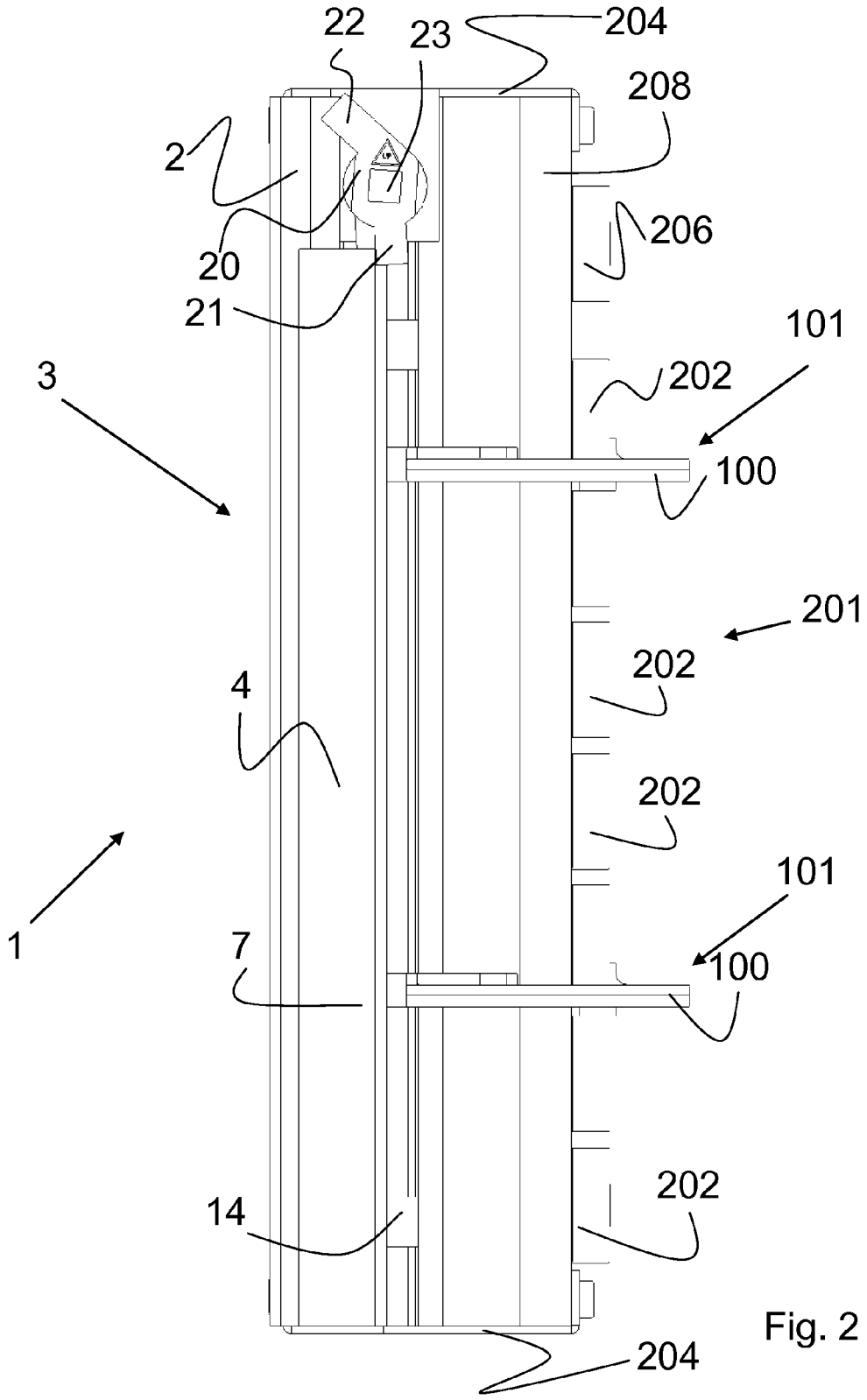
FIG. 2 shows a front view of the tilt prevention assembly shown in FIG. 1.

Now referring to FIG. 2, it can be seen that the securing means 3 according tot the present invention comprise a securing profile 4, which in the embodiment shown is formed as an elongated securing bar and which extends along the height of frame 2. The frame 2 also comprises a lock 20, which is suitable to counter pivoting of the securing profile 4, and which is suitable for locking the tool cabinet as will be explained later. Pivoting of a key member at the front side of the cabinet causes, by means of a pivoting of a bar, pivoting of the lock 20 onto the frame. The bar engages on a recess 23 in the lock. A locking member 21 at the lock 20 moves the securing profile 4 into the securing position. The closed drawers are then locked. A counter-pivoting movement of the lock 20, by means of an unlocking member 23 on the lock 20, brings the securing bar back to the releasing position. The right side of FIG. 2 shows in closer detail the slide prevention means 201, whose construction and function can better be explained by means of FIG. 3.

Figure 3:
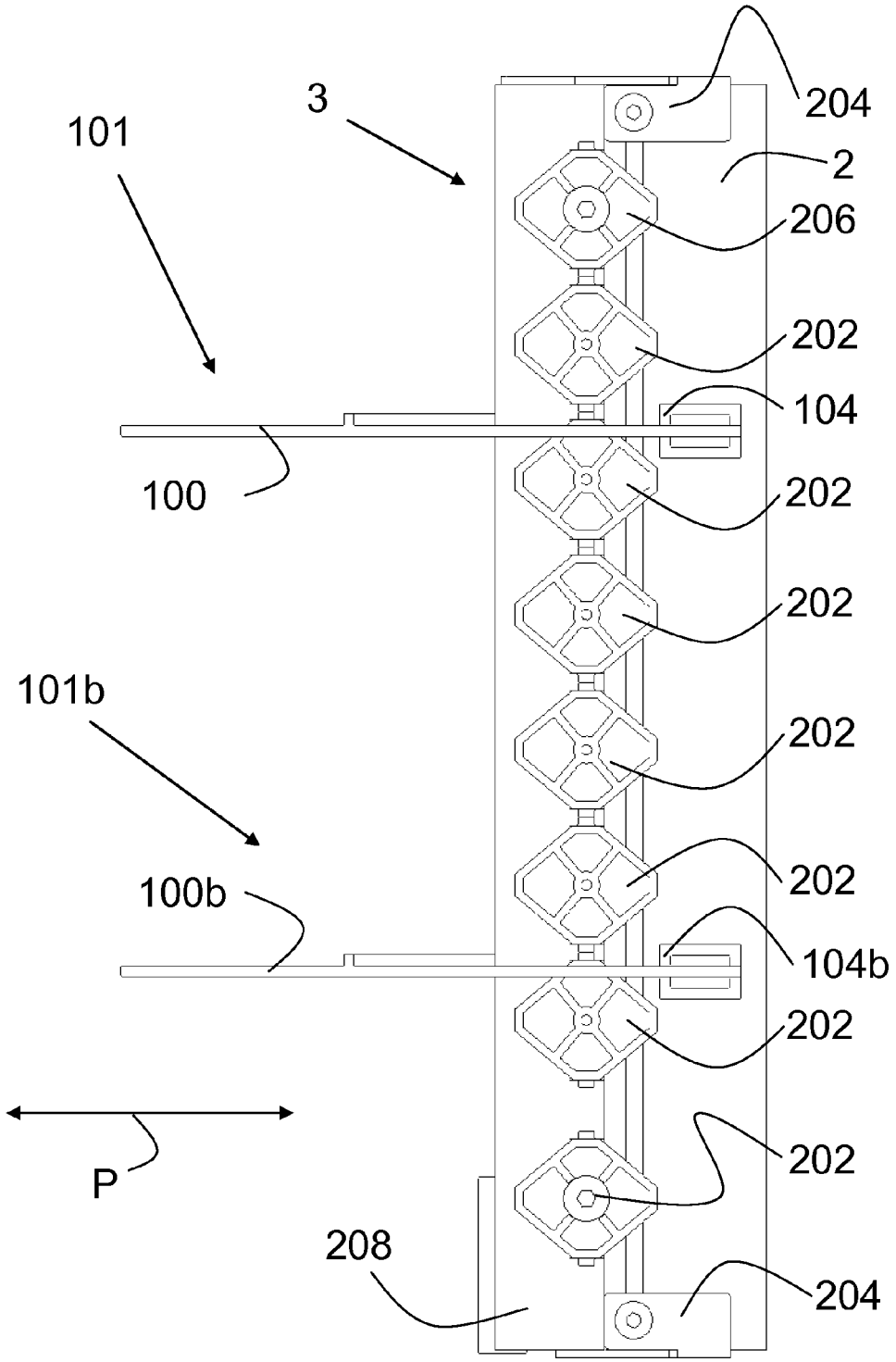
FIG. 3 shows a side view of the tilt prevention assembly shown in FIG. 1 and FIG. 2.

FIG. 3 shows a side view of the assembly 1, wherein it is clearly shown that the slide prevention means 201 comprise a plurality of movable blocking elements 202 which are placed in a vertical row. The length of the track along which these slide prevention means 201 are movable is slightly larger than the combined dimension of the movable blocking elements 202 in said track, such that between adjacent blocking elements 202 only a limited space for passing through a part of a drawer can be formed. In the embodiment shown, use is made of actuator members 101 attached to the drawer, comprising a plate-like base body 100, each of which is provided with a finger-like slide prevention member 104. This slide prevention member is suitable for, when in use, and when pulling a drawer, moving the blocking elements 202 in a direction perpendicular to the slide movement (indicated with arrow P) of the drawer. The actuation member 101 has a square-like shape, with a height which nearly matches the available space between the blocking elements 202. FIG. 3 further shows that at the ends of the row enclosing elements 202 are provided, which can be used to set the available space between the blocking elements 202, but also to set the outer positions of the outer blocking elements 202. In an embodiment the enclosing elements are adjustable. It is conceivable that an adjustable blocking element 206 (see top side row in FIG. 3), which is fixably mountable in the row, serves as adjustable enclosing element 206.

Figure 4:
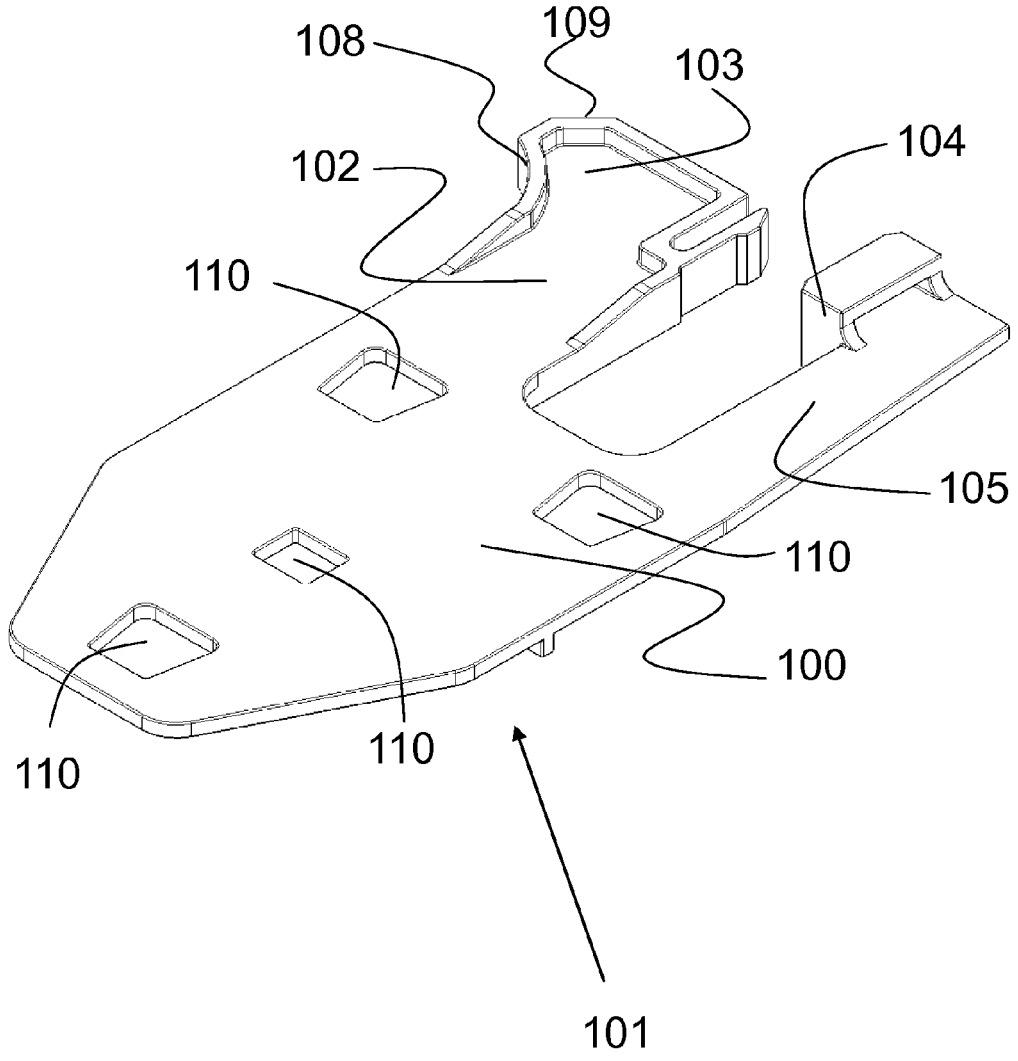
FIG. 4 shows a perspective view of an actuator member for use in the tilt prevention assembly according to the present invention.

FIG. 4 shows a perspective view of an actuation member 101, which is mountable to a drawer by means of mounting means 110, and which is, in the embodiment shown, arranged to activate both the securing means 3 in the form of the securing profile 4, as well as the slide prevention means 201 when pulling or closing a drawer. The actuation member 201 is substantially shaped in the form of a plate, having a first part 100 provided with holes 110 suitable for connecting the actuation member 101 to the drawer. From the first part 100 a cam part 102, and a slide prevention member 104 extend towards the back via an arm 105. The cam part 102 is substantially L-shaped, with a leg 102 of the L which is attached to the first part 100, and a base 103 of the L which extends somewhat to the outside. The cam part 102 comprises an edge that extends transversely to the plate 100. The edge comprises, at the location of the outer part of the base of the L, a first surface 108 which is directed towards the first part 100, and a second surface 109 which extends away from the first part 100. The two surfaces enclose an angle, such that the base of the L has a point-shaped tip. From the first part 100, an arm 105 also extends towards the back, parallel to the cam part 102. A slide prevention member 104 is placed under an angle with respect to the arm 105 to form an L-shape. The base of the L is formed by the slide prevention member 104.

Figure 5A:
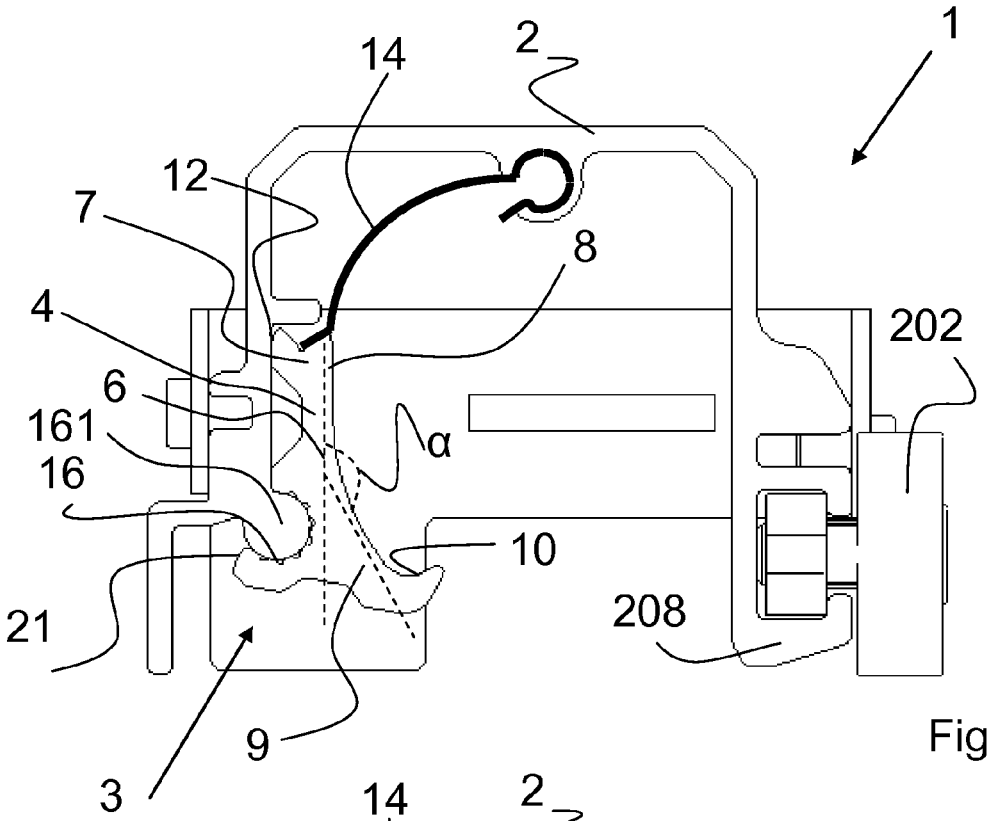
FIGS. 5*a* and 5*b* show top views of the assembly in an unlocked condition and a locked condition, respectively, of the securing profile.
Figure 5B:
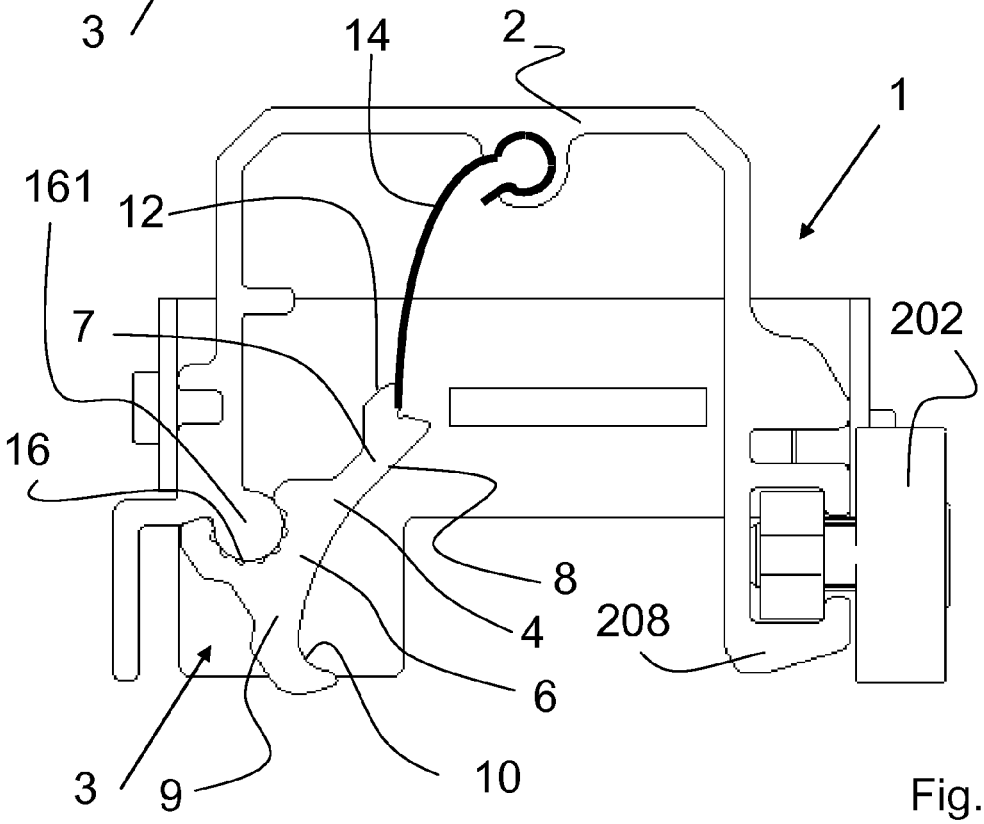

FIGS. 5*a* and 5*b* show in detail a top view of the tilt prevention assembly 1 according to the present invention, whereby it will in particular become clear how the functioning is of the securing means 3 in the shape of the securing profile 6. As FIG. 5*a* shows, the securing means 3 comprise a securing profile 6 shaped as a securing bar 4, having a first profile part 9 and a second profile part 7, which substantially extends at an angle α with respect to the first profile part 9. The first profile part 9 comprises a first actuation surface 10 directed towards the second profile part 7. The second profile part 7 comprises a second actuation surface 8 directed towards the first profile part 9. In general a side facing away from the first actuation surface 10 and the second actuation surface 8 of the securing profile 6 can form a securing surface. In the embodiment shown, which is relatively simple and effective, a side facing away from the second profile part 7 of the second actuation surface 8 forms the securing surface 12. The profile is placed with the axis connecting means 16 on a cylinder shaped extension 161 of the frame 2. The axis connecting means 16 comprise a cylinder shaped recess in the profile 6. The recess is situated between the outer parts of the first profile part 9 and the second profile part 7, and forms herewith a triangle, and in such a way that the distance between the outer ends of the profile parts 7, 9 determine the base of the triangle.

FIG. 5*b* shows that the securing profile 6 (in the form of securing bar 4) is pivotable about the axis of the frame 2, so as to pivot securing profile 6 to the securing position. Thereby a stop 21 (see FIG. 5*a*) near the axis connecting means 16 takes care that the pivoting movement is not possible beyond the securing position, because it touches with the frame 2. In the releasing position (FIG. 5*a*) the securing surface 12 forms a stop which is located against a wall of the frame 2, such that the pivoting movement beyond the releasing position is not possible. By means of aforementioned stops the movement of the integrally formed securing profile 6 is limited.

FIGS. 5*a* and 5*b* further show that between the frame 2 and the pivotable securing profile a spring element 14 is provided. This spring element is suitable for pivoting the profile to one of its outer positions (securing position, releasing position). A further embodiment of the urging means can be found in FIG. 9, where the urging means is formed by a urging assembly 300, comprising a first urging part 302 which is pivotably connected with a first end to the frame 2 and a second urging part 306 which is located at a further end of the first urging part 302 and which is able to move, in a limited manner, in the longitudinal direction of the first urging part 302. The urging parts 302, 306 slide in and out of each other. The second urging part 306 is pivotably connected to the securing profile in the shape of the securing bar 4. An urging spring 304 between both urging parts 302, 304 pushes the securing bar 4 in either the releasing position or the securing position.

The operation of the securing profile 6 in the form of securing bar 4 will be explained in more detail on the basis of FIG. 6 up to and including 8.

Figure 6:
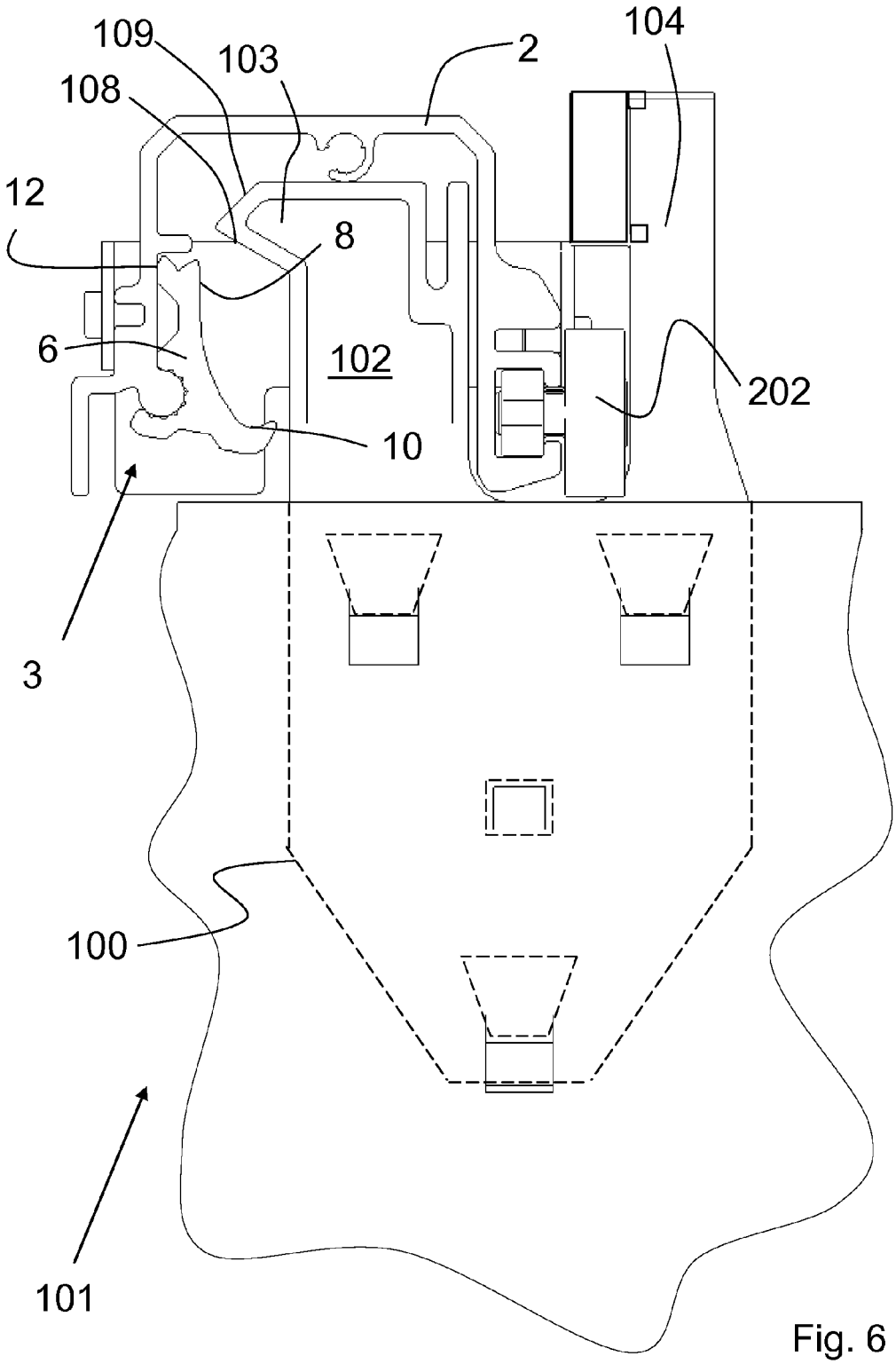
FIG. 6 shows a top view of the tilt prevention assembly in the unlocked position.

FIG. 6 shows the tilt prevention assembly 1, with the securing profile 6 in the releasing position, and with the drawers (not shown) having actuating members 101 attached thereto, in a closed condition, which means, the drawers are completely enclosed in the tool cabinet (not shown). The point-shaped cam 103 of the actuation member is thereby located in line with the second actuation surface 8, and is placed at a certain distance thererof, such that the cam 103 can move along the second actuation surface 8.

Figure 7:
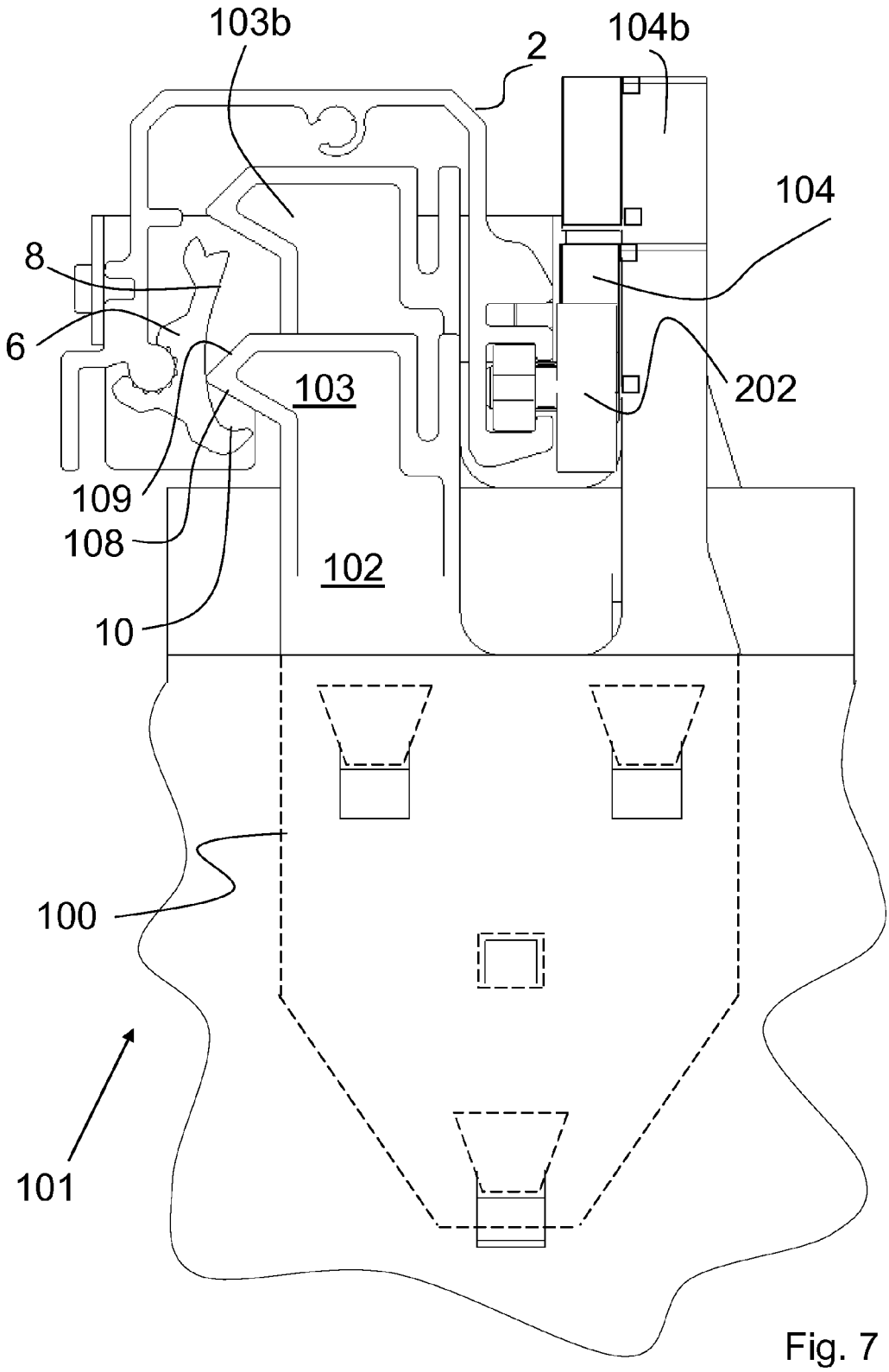
FIG. 7 shows a top view of the tilt prevention assembly upon movement of the securing profile from the securing position into the releasing position, or vice versa.

FIG. 7 shows the situation wherein a drawer is pulled. Thereby one can see that the finger-like slide prevention member 104 has come into contact with one of the blocking elements 202 (right side FIG. 7). The cam 103 has thereby come into contact with the surface, which surface is determined by the sides of the first 9 and the second profile part 7 that are directed towards each other. By means of this contact, the securing profile 6 will follow the cam 103, such that upon movement beyond the first actuation surface 10 a pivoting of the securing profile 6 into the securing position will be accomplished. This movement will cause the securing surface 12 to move in the direction of the cam 103 of a remaining drawer, and to move until just before the first cam surface 108.

Figure 8:
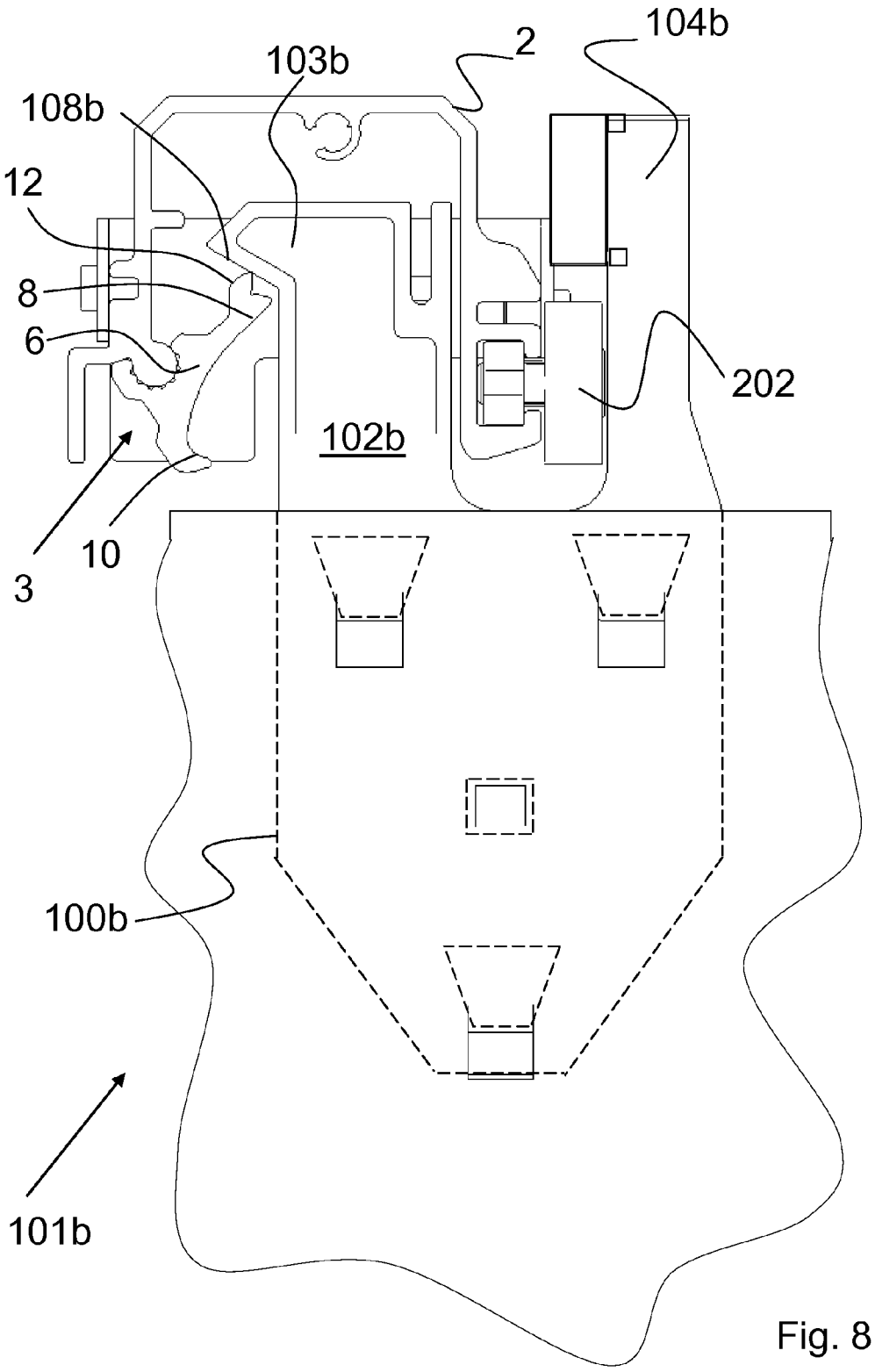
FIG. 8 shows a top view of the tilt prevention assembly in the secured position.
Figure 9A:
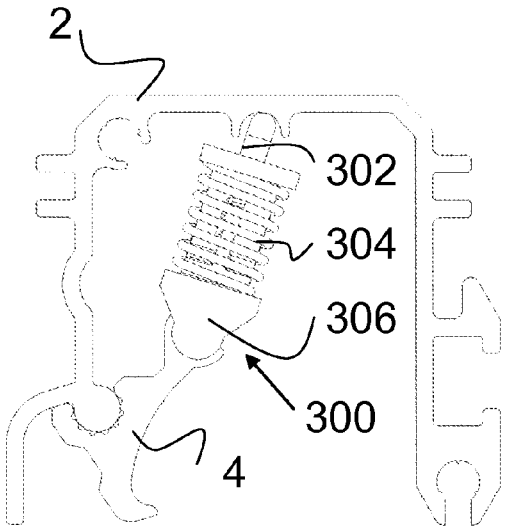
FIG. 9*a*-9*d* show top views and perspective views of the urging assembly.
Figure 9B:
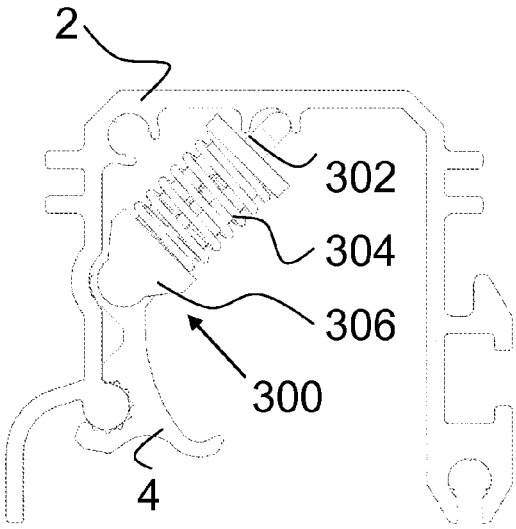
Figure 9C:
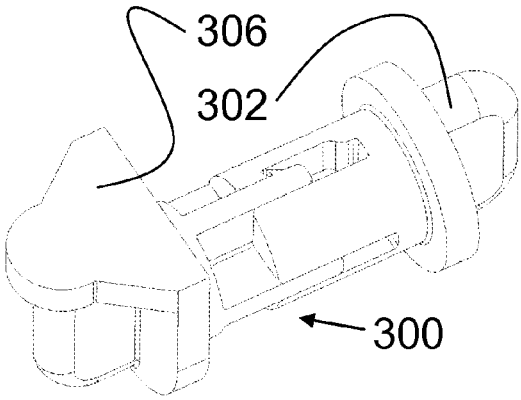
Figure 9D:
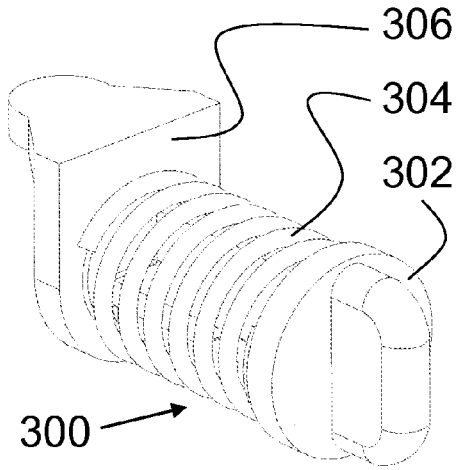

That situation is shown in FIG. 8. Since the securing surface 12 is positioned before the first cam surface 108, the further drawer which is provided with a further actuation member 101*b* can not be brought in the opened condition. The rigid implementation of the securing profile 4, in a simple manner accomplished via the integral implementation of the securing profile 6, as well as the use of the stop, such that pivoting movement beyond the securing position is not possible, take care that the cam member 103 of the drawer can not move beyond the securing bar 6. Hereby further drawers can not be opened.

It should be noted that according to the present invention the slide prevention means 201 are provided, such that simultaneously drawing out of a number of drawers, which is in principle possible when solely the securing profile 6 would be applied, is not allowed anymore.

Therewith in a simple and effective way is achieved that only one drawer at a time can be opened. Because the weight of a single drawer is too little to move the point of gravity of the cabinet in a substantial way, the stability of the cabinet is sufficient to avoid tilting of the tool cabinet.

Figure 10:
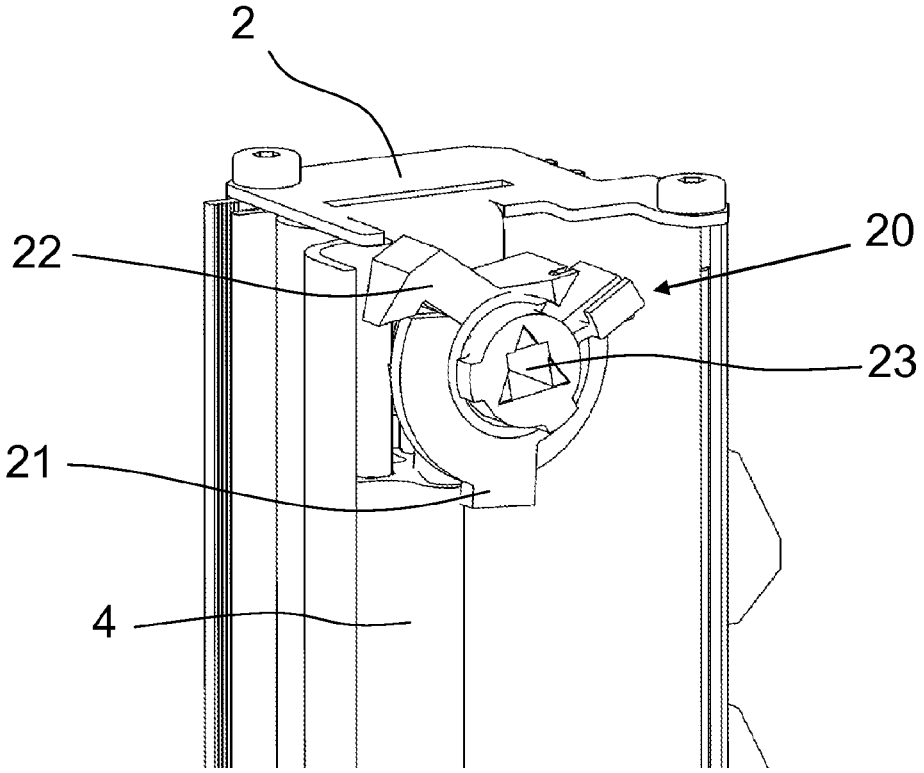
FIG. 10 shows a perspective view of the lock.

FIG. 10 shows a perspective view of lock 20 in combination with the frame 2 and the securing profile 4. With the lock 20 the tool cabinet can be locked. In lock 20 a rectangular recess 23 is provided. A bar that is not shown engages in the recess 23. The bar extends at the front side of the tool cabinet. At the front side the bar is in contact with a key member, which through movement of the key pivots the bar.

Preferably the bar pivots during said movement by an angle of approximately 90 degrees. By means of a key the user can pivot the bar and thereby the lock 20.

The lock 20 comprises, at the bottom side in FIG. 10, a closing member 21. The locking member 21 extends transversely to the pivoting axis of the bar. When pivoting the lock 20, locking member 21 makes a curved motion. When closing the lock 20, the lock pivots, in FIG. 10, in the clockwise direction. The securing bar 4 is positioned in the path of motion of the locking member 21, when the securing bar 4 is located in the releasing position. Via contact with the locking member 21 the securing bar 4 is driven from the releasing position into the securing position. The locking member 21 prevents the securing bar 4 to return to the releasing position. The drawers are thereby locked.

To unlock the drawers a unlocking member 22 is provided at the lock 20. The unlocking member 22 protrudes from the lock 20. To unlock the lock 20, the user pivots the key, and thereby the bar and the lock 20 in opposite direction compared to when closing. In FIG. 10 the unlocking direction is counter clockwise. The locking member 21 moves thereby away from the securing bar 4, so that it moves towards the releasing position. During pivoting movement, the unlocking member 22 pushes against the securing bar 4 and drives it to the releasing position. Both the locking member 21 and the unlocking member 22 pivots subsequently to such positions, that they form no obstructions for opening of the drawers. The drawers are in this way unlocked.

Figure 11A:
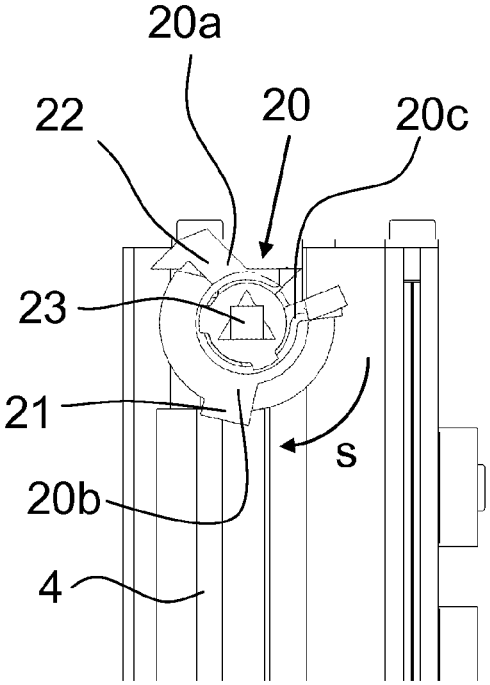
FIGS. 11*a* and 11*b* show a front view of the lock in locked and unlocked condition, respectively.

FIG. 11*a* shows a front view of the lock 20 in closed condition. To lock the lock 20 and thereby lock the tool cabinet, the user pivots the lock in the closing direction s. The locking member 21 pushes the securing bar 4 subsequently in the locking position. Subsequently the locking member 21 remains positioned in front of the securing bar 4, so that it can not return to the releasing position.

The lock 20 is arranged to enable closing of an opened drawer in the locked condition. The lock 20 comprises two lock parts 20*a*, 20*b* that are pivotable with respect to each other. The lock parts 20*a*, 20*b* are dynamically fixated with respect to each other by means of a driving means 20*c*. The driving means 20*c* allows, however, that in the locked position as shown in FIG. 11*a*, an opened drawer can be closed. The base 8 of a plate-like base body 109 thereby moves along and against the second actuation surface 8 of the securing bar 4. The securing bar 4 pushes in this case against the locking member 21. Because the lock parts 20*a*, 20*b* can pivot relative to each other, the locking member 21 can move in the direction opposite to the closing direction s. The first lock part 20*a* is thereby rigidly connected to the bar. In this way a limited freedom of movement is created whereby the drawer can be closed. The locking member 12 is driven back against the securing bar 4 by the driving means 20*c*. When the drawer is closed, the driving means 20*c* pushes the securing bar 4 back towards the locking position.

Figure 11B:
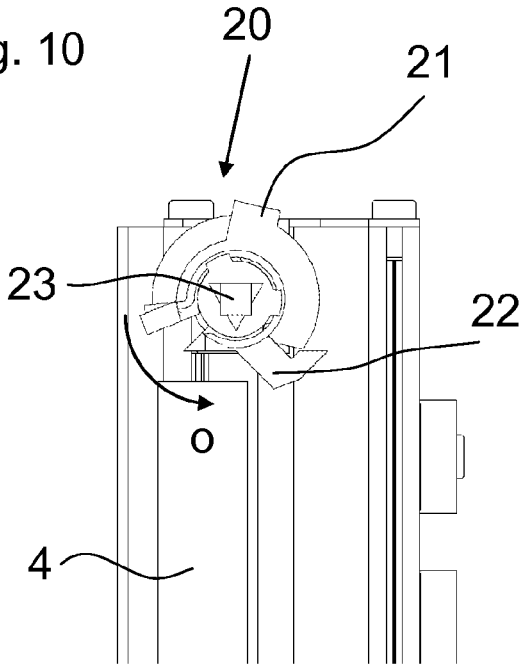

FIG. 11*b* shows a front view of the lock 20 in unlocked condition. A user pivots to this end the lock in the opening direction o. The locking member 21 moves out of the path of the securing bar 4. Subsequently the unlocking member 22 pushes the securing bar 4 in the unlocked position. In FIG. 11*b* it can be seen that after unlocking, the locking member 21 and the unlocking member 22 are located at a distance of the securing bar 4.

Figures 12A, 12B, 12C, 12D:
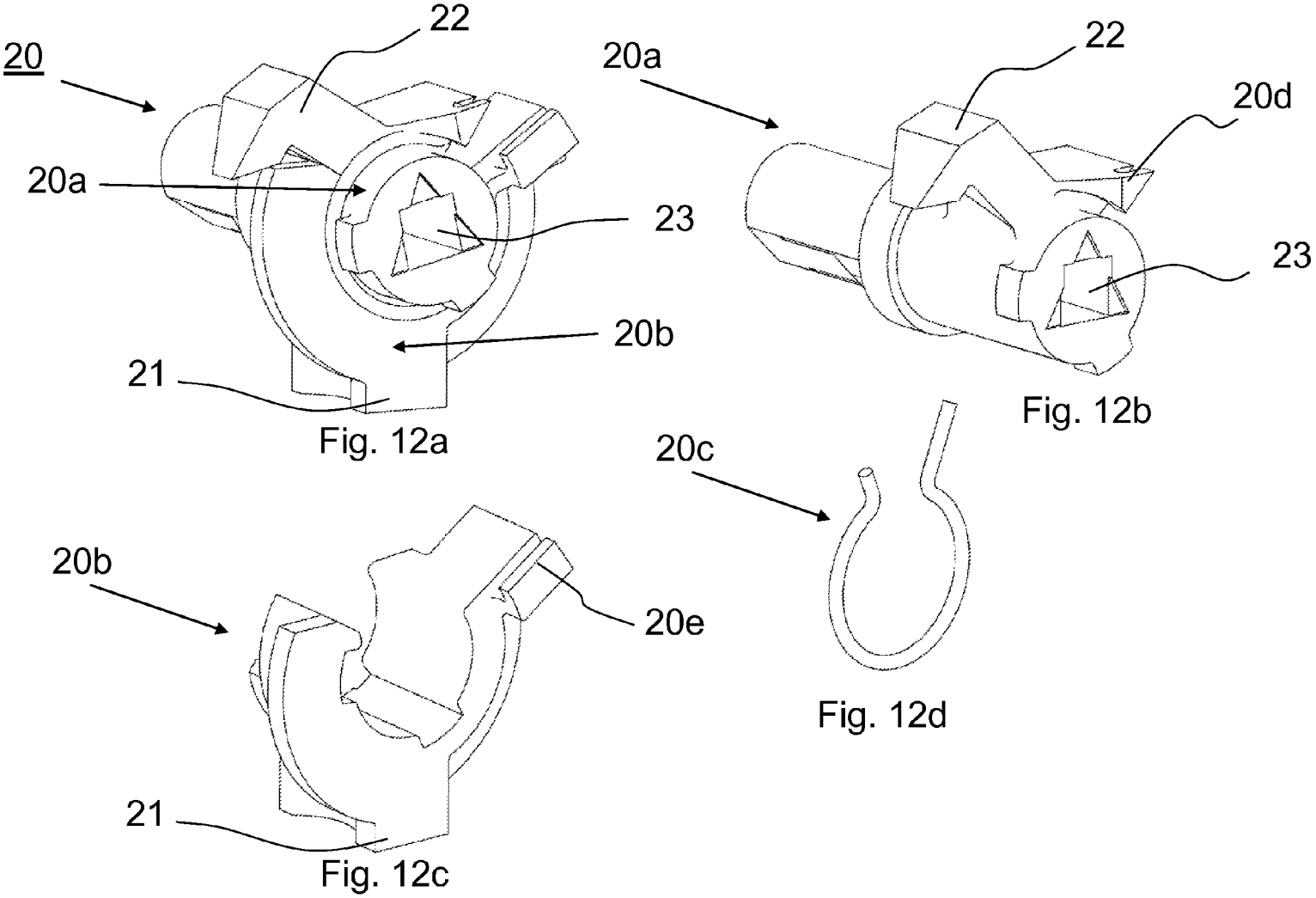
FIG. 12*a-d* show perspective views of the lock and its components.

FIG. 12*a* shows the lock 20 in an assembled condition. In FIG. 12*b* a first lock part 20*a* is shown. The first lock part 20*a* comprises the unlocking member 22. This lock part 20*a* is in use rigidly connected to the bar by means of the recess 23. When the lock 20 is closed, the first lock part 20*a* is static relative to the bar and the frame 2.

FIG. 12*c* shows the second lock part 20*b*. In use the second lock part 20*b* is partly located around the first lock part 20*a*. The second lock part 20*b* can thereby pivot about the first lock part 20*a*. Both lock parts 20*a*, 20*b* are connected by a driving means 20*c*, which engages the driving means connections 20*d*, 20*e*. Preferably the driving means 20*c* is a torsion spring which is connected with each end to a driving means connection 20*d*, 20*e*, as shown in FIG. 12*d*.

In locked condition of the lock 20 the first lock part 20*a* is rigidly connected to the bar and can therefore not move. The second lock part 20*b* can pivot about the first lock part 20*a*. This pivoting movement is limited by the driving means 20*c*, which connects both locking parts 20*a*, 20*b*. When, during closing of an opened drawer, the securing bar 4 pushes against the locking member 21, then the second lock part 20*b* pivots in a limited way about the first lock part 20*a* to be able to close the drawer. The driving means 20*c* forces thereafter the lock parts 20*a*, 20*b* en thereby the locking member 21 back in to their original positions in the securing position. In such a way, it is possible to close an opened drawer in a locked condition. Besides the lock 20 in FIG. 12*a-d* is arranged to compensate for some tolerance in the pivoting direction of the lock.

It will be clear to the person skilled in the art that the invention is explained on the basis of several possible embodiments, which are preferred. The invention is however not limited to these embodiments. Within the framework of the invention a lot of modifications are possible. The requested protection is determined by the attached claims.

The invention claimed is:

1. A tilt prevention assembly for a series of drawers in a tool cabinet, comprising:

a frame which, when in use, is connected to the tool cabinet, slide-out prevention means which are connected to the frame, the slide-out prevention means comprising a plurality of blocking elements arranged in a row, which blocking elements, when in use, are moveable perpendicularly to the sliding direction of the series of drawers;

a single securing profile pivotably mounted to the frame with a first profile part and a second profile part extending from the first profile part at an angle, wherein the securing profile is pivotable between a securing position in which the securing profile forms an obstruction for the movement of the series of closed drawers and a releasing position in which one of the series of drawers is moveable to at least an extended position, wherein the securing profile comprises a securing surface which in the securing position of the securing profile forms an obstruction for the movement of the closed drawers of the series of drawers, and wherein two sides of the first profile part and the second profile part, which two sides are facing each other, define at least two actuator surfaces which are arranged to collaborate with an actuator member on one of the series of drawers for pivoting, under the influence of the movement of one of the series drawers, the securing profile into the securing position or into the releasing position; and a number of actuator members which, when in use, are each connected to one of the series of drawers, wherein the actuator members each comprise a cam part arranged to collaborate with the actuator surfaces of the securing profile, wherein the cam part is substantially L-shaped, and wherein the base of the L is arranged to collaborate with the actuator surfaces of the securing profile, and wherein the base of the L comprises a first cam surface which, when in use, is facing the drawer, as well as a second cam surface which, when in use, is facing away from the drawer, wherein the first cam surface is arranged to collaborate with the first actuator surface, and wherein the second cam surface is arranged to collaborate with the second actuator surface.

2. Tilt prevention assembly, according to claim 1, wherein the first and the second cam surface are extending at an angle with respect to one another.

3. A tilt prevention assembly for a series of drawers in a tool cabinet, comprising:

a frame which, when in use, is connected to the tool cabinet, slide-out prevention means which are connected to the frame, the slide-out prevention means comprising a plurality of blocking elements arranged in a row, which blocking elements, when in use, are moveable perpendicularly to the sliding direction of the series of drawers;

a single securing profile pivotably mounted to the frame with a first profile part and a second profile part extending from the first profile part at an angle, wherein the securing profile is pivotable between a securing position in which the securing profile forms an obstruction for the movement of the series of closed drawers and a releasing position in which one of the series of drawers is moveable to at least an extended position, wherein the securing profile comprises a securing surface which in the securing position of the securing profile forms an obstruction for the movement of the closed drawers of the series of drawers, and wherein two sides of the first profile part and the second profile part, which two sides are facing each other, define at least two actuator surfaces which are arranged to collaborate with an actuator member on one of the series of drawers for pivoting, under the influence of the movement of one of the series drawers, the securing profile into the securing position or into the releasing position; and a number of actuator members which, when in use, are each connected to one of the series of drawers, wherein the actuator members each comprise a cam part arranged to collaborate with the actuator surfaces of the securing profile, and wherein each of the actuator members is provided with a slide preventing member arranged for, when in use while extending a drawer, moving the blocking elements, especially wherein the slide preventing member extends in a direction transverse to the drawer extending direction.

* * * * *